US006789705B2

(12) United States Patent
Drew

(10) Patent No.: US 6,789,705 B2
(45) Date of Patent: Sep. 14, 2004

(54) AEROSOL DISPENSER SPRAYING APPARATUS

(76) Inventor: Frank M. Drew, 3004 Lougland Cove, Austin, TX (US) 78746

( * ) Notice: Subject to any disclaimer, the term of this patent is extended or adjusted under 35 U.S.C. 154(b) by 167 days.

(21) Appl. No.: 10/294,414

(22) Filed: Nov. 14, 2002

(65) Prior Publication Data

US 2004/0094577 A1 May 20, 2004

(51) Int. Cl.[7] ..... B67D 5/64
(52) U.S. Cl. ..... 222/174; 248/310
(58) Field of Search ..... 222/174, 402.1–402.25; 248/310, 311.2

(56) References Cited

U.S. PATENT DOCUMENTS 3,013,699 A * 12/1961 Meuwly ..... 222/174
3,017,056 A * 1/1962 Bishop ..... 222/164
3,039,657 A 6/1962 Meuwly
3,220,613 A 11/1965 Palmer et al.
3,679,319 A * 7/1972 Munchel et al. ..... 401/138
3,794,217 A * 2/1974 Munchel ..... 222/174
3,856,209 A 12/1974 Hickson
3,949,440 A 4/1976 Guerra
4,089,440 A 5/1978 Lee
4,457,472 A 7/1984 Geberth, Jr.
4,886,191 A 12/1989 Yoshitomi
5,787,536 A 8/1998 Pate
6,260,275 B1 7/2001 Good
6,390,336 B1 * 5/2002 Orozco ..... 222/162

* cited by examiner

*Primary Examiner*—Gene Mancene
*Assistant Examiner*—Patrick Buechner
(74) *Attorney, Agent, or Firm*—David O. Simmons

(57) ABSTRACT

An apparatus for receiving an aerosol dispenser and for operating the aerosol dispenser at a distant position from an operator. The device includes an elongated body, an extension pole mount, an actuation member mount and an actuation member. The elongated body includes an aerosol dispenser-receiving cavity therein. The aerosol dispenser-receiving cavity extends from a first end of the body toward a second end of the body. The extension pole mount is attached to the second end of the body. A longitudinal axis of a pole-receiving cavity of the extension pole mount is aligned with a longitudinal axis of the aerosol dispenser-receiving cavity. The actuation member is attached at a first end thereof to an actuation member mount attached to the body. A spray head engagement portion is movable between at-rest and actuation positions and is translatable along an axis parallel to the longitudinal axis of the dispenser-receiving cavity.

37 Claims, 4 Drawing Sheets

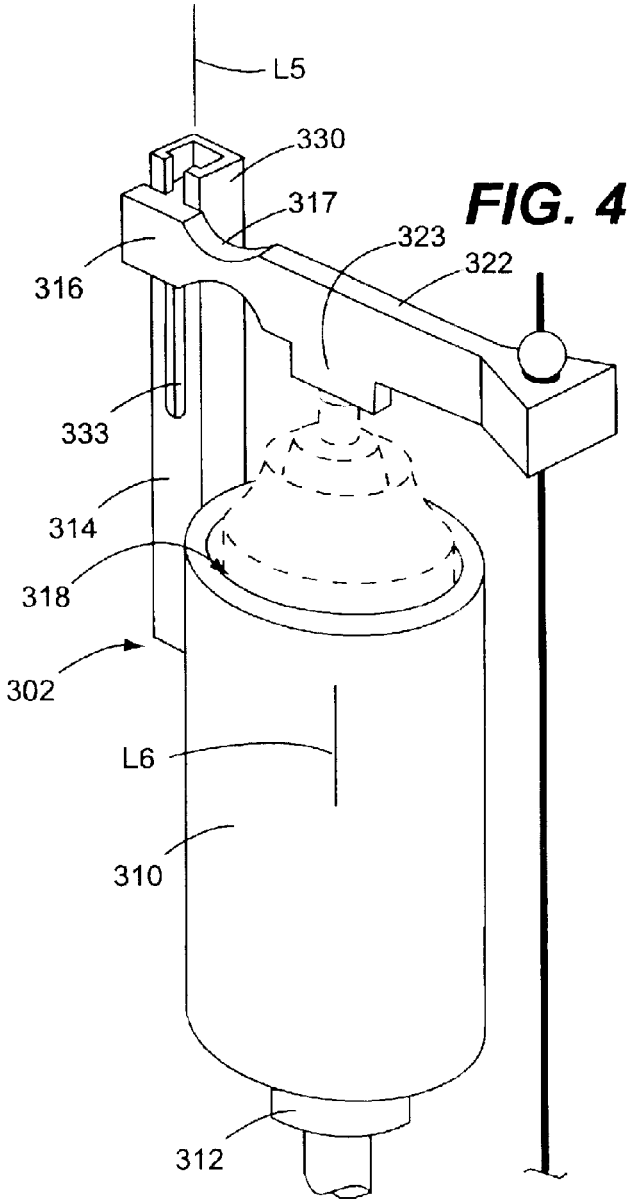
FIG. 4
FIG. 5
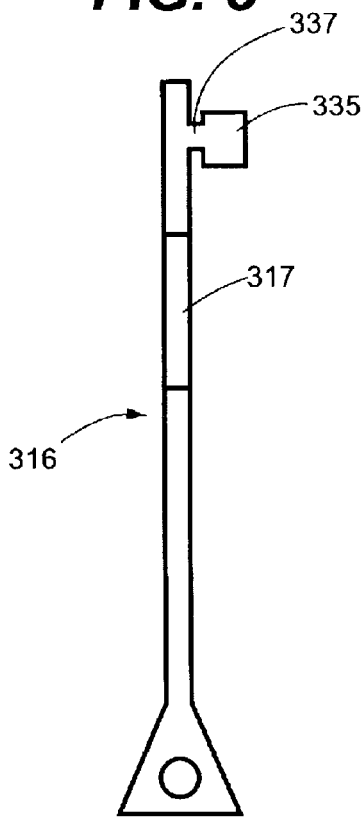

AEROSOL DISPENSER SPRAYING APPARATUS

FIELD OF THE DISCLOSURE

The disclosures herein relate generally to aerosol dispensers and, more particularly, to apparatuses adapted for receiving an aerosol dispenser and for operating the aerosol dispenser at a distant position from an operator.

BACKGROUND OF THE DISCLOSURE

An aerosol can is an example of an aerosol dispenser. An aerosol dispenser refers to a container that has a pressurized gas and fine particles of a solid or a liquid therein and that is adapted for spraying the fine particles therefrom. Such a dispenser includes a container having a spray head attached in a manner whereby the spray head may be selectively operated In certain situations, it is desirable for a person to apply a composition via an aerosol dispenser at a distant position (e.g., more than an arm's length) from the person. Examples of such situations include applying a protective pruning seal to cuts and wounds on a plant, applying a protective coating such as paint on a structure and applying a pest control composition on pests. The use of a ladder to reach distant locations for applying compositions via an aerosol dispenser is often inconvenient or not feasible. Furthermore, it is generally desirable to apply the compositions in a neat, accurate and reasonably unencumbered manner, which necessitates being able to operate and position the aerosol dispenser in a controlled manner.

Apparatuses adapted for both pruning plants and applying a protective pruning seal via an aerosol dispenser are known. Apparatuses adapted exclusively for applying a composition from an aerosol dispenser at a distant location from an operator are also known. Such known apparatuses are referred to herein as conventional remote aerosol dispenser spraying apparatuses.

Such conventional remote aerosol dispenser spraying apparatuses suffer from one or more limitations. Examples of such limitations include being difficult to maneuver due to their size and weight, actuation leading to application of adverse off-center forces acting on can spray buttons that are susceptible to damage from such forces, being relatively expensive due to cost associated with integral specialized limb cutting components, being cost-prohibitive for use of solely applying aerosol can-dispensed compositions, being cumbersome to operate due to multi-function utility and being cumbersome to operate due to complexity associated with an aerosol spraying portion thereof. Therefore, a remote aerosol dispenser spraying apparatus that overcomes limitations associated with conventional remote aerosol dispenser spraying apparatuses would be useful.

BRIEF DESCRIPTION OF THE DRAWING FIGURES

FIG. 4 depicts an apparatus adapted for receiving an aerosol dispenser and for operating the aerosol dispenser at a distant position from an operator in accordance with a second embodiment of the disclosures made herein.

FIG. 5 depicts a plan view of an actuation member depicted in FIG. 4.

DETAILED DESCRIPTION OF THE DRAWING FIGURES

The disclosures made herein relate to various aspects of apparatuses adapted for receiving an aerosol dispenser and for operating the aerosol dispenser at a distant position from an operator. Such apparatuses, which are in accordance with embodiments of the disclosures made herein, are adapted for overcoming limitations associated with conventional apparatuses providing related functionality. An objective of apparatuses as disclosed herein is to aid a person (i.e., an operator) in applying a composition dispensed from an aerosol dispenser at out-of-reach locations.

It is advantageous, but not essential, that remote spray apparatuses as disclosed herein have a standalone configuration in which the apparatus is configured for exclusively receiving an aerosol dispenser and for operating the aerosol dispenser. In such a standalone configuration, attributes such as cost, weight, maneuverability, simplicity and reliability may be enhanced relative to an apparatus that is designed to be multi-functional (e.g., an pruning apparatus that performs both pruning and pruning seal dispensing functionality). Specific examples of enhancements to such attributes include: (1) a standalone apparatus can be used on cuts made by any pruning tool—loppers, saws, or chain saws; (2) the maneuvering of the dispenser is not encumbered or inhibited by the size and weight of co-mounted cutting hardware; (3) a control element (e.g., a single lanyard) provides simple design and operation; (4) the absence of ancillary tools (e.g., attached loping and/or cutting tools) at the end of the pole makes possible the use of a relatively lighter and relatively low-strength extension pole; and (5) a relatively small and light head at a distal end of the extension pole enhances the ability to accurately maneuver and position the distal end of the extension pole.

Figure 1:
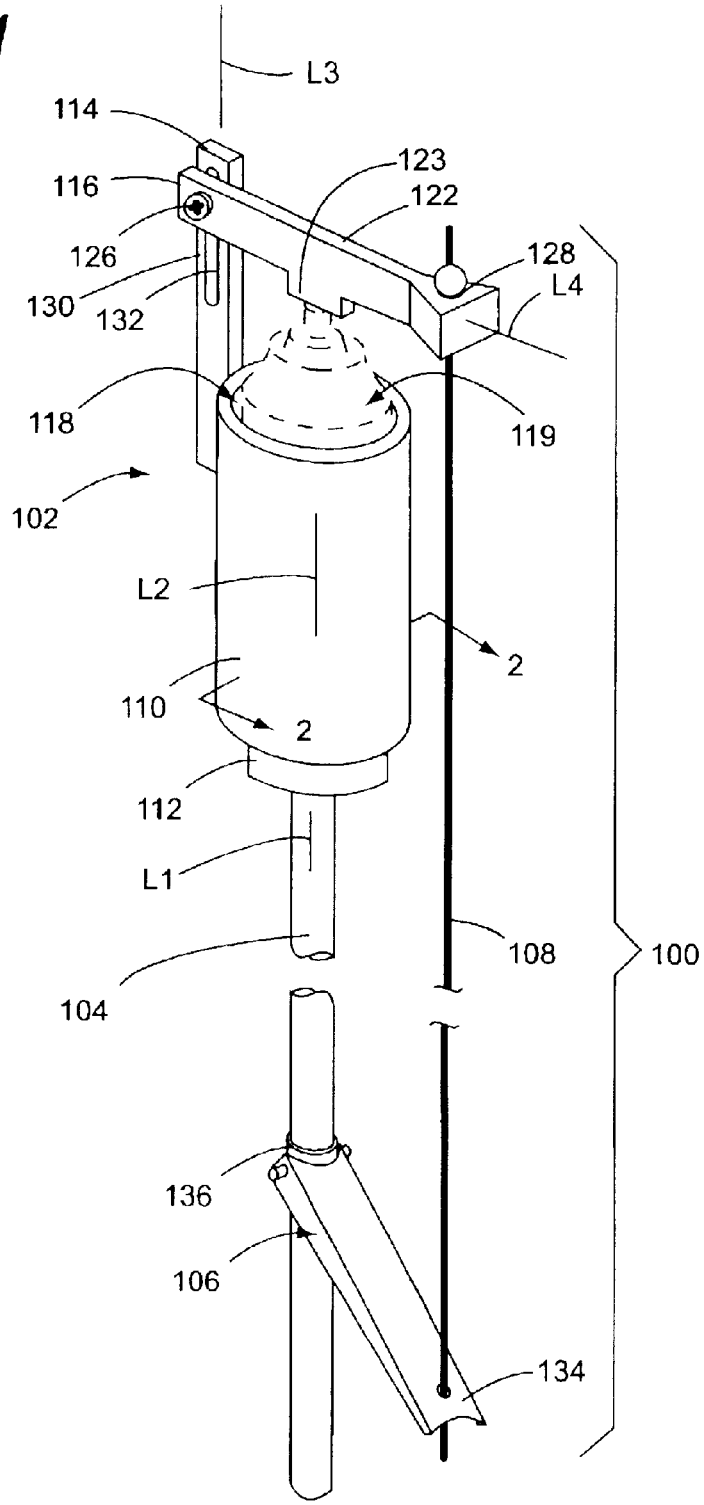
FIG. 1 depicts an apparatus adapted for receiving an aerosol dispenser and for operating the aerosol dispenser at a distant position from an operator in accordance with a first embodiment of the disclosures made herein.

Turning now to specific drawings, an apparatus 100 in accordance with an embodiment of the disclosures made herein is depicted in FIG. 1. The apparatus 100 includes a head assembly 102, an extension pole 104 and an actuation handle assembly 106. The extension pole 104, which may be fixed length or variable length, is attached at a first end thereof to the head assembly 102. The actuation handle assembly 106 is mounted on the extension pole 104 adjacent to a second end of the extension pole 104. A lanyard 108 (e.g., a cord) is attached between the actuation handle assembly 106 and the head assembly 102 for enabling selective operation of the head assembly 102. The lanyard 108 is an example of a manually operable control element.

Figure 2:
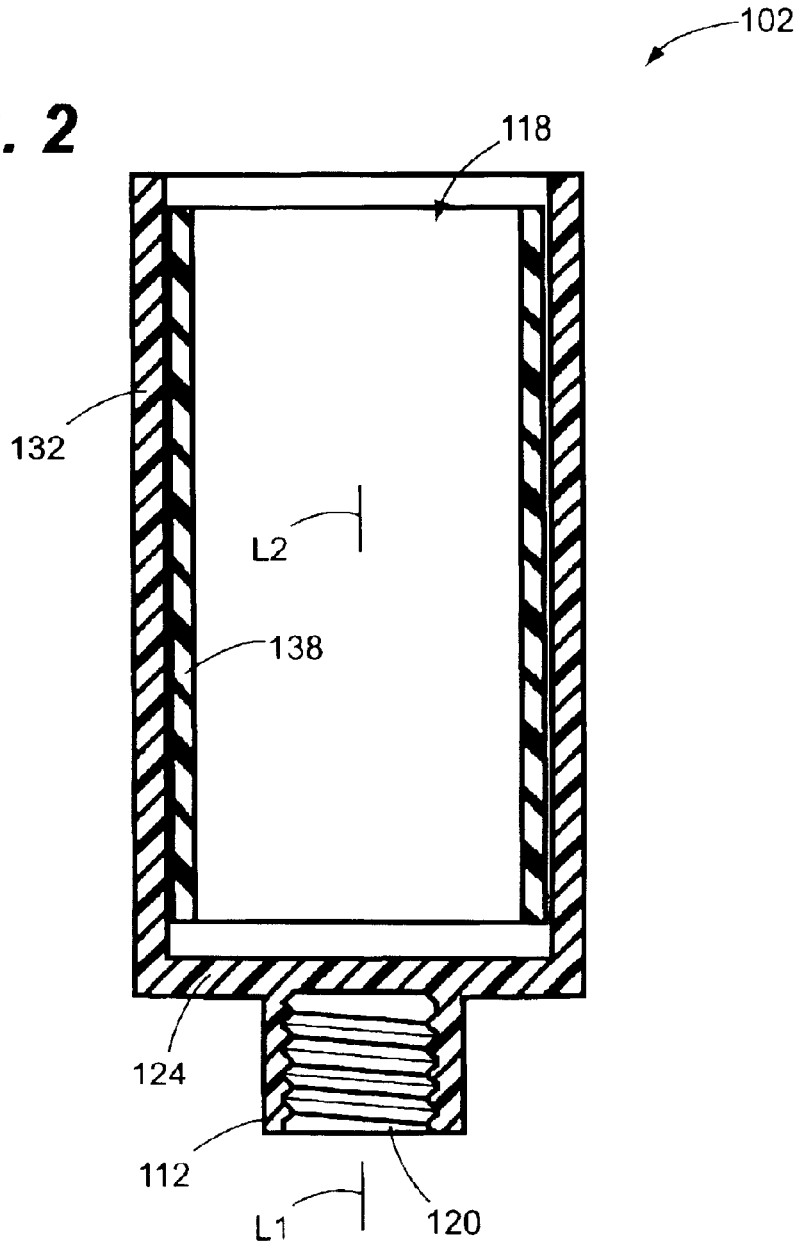
FIG. 2 depicts a cross sectional view of a head assembly of the apparatus depicted in FIG. 1.

Referring to FIGS. 1 and 2, the head assembly 102 includes an elongated body 110, an extension pole mount 112, an actuation member mount 114 and an actuation member 116. The elongated body 110 includes an aerosol dispenser-receiving cavity 118 therein. An aerosol dispenser 119, such as an aerosol can, may be placed in the aerosol dispenser-receiving cavity 118. In a preferred embodiment, the aerosol dispenser-receiving cavity 118 is a generally cylindrical cavity. However, it is contemplated that that the aerosol dispenser-receiving cavity 118 may be a rectangular cavity, triangular cavity or other shaped polygon cavity. The aerosol dispenser-receiving cavity 118 extends from a first end (i.e., an open end) of the elongated body 110 toward a second end (i.e., a generally closed end) of the elongated body 110. The extension pole mount 112 is attached to the second end of the elongated body 110. A longitudinal axis L1 of a pole-receiving cavity 120 of the extension pole mount 112 is generally aligned with a longitudinal axis L2 of the aerosol dispenser-receiving cavity 118. Preferably, the longitudinal axis L1 of the pole-receiving cavity 120 of the extension pole mount 112 is generally aligned with the longitudinal axis L2 of the aerosol dispenser-receiving cavity 118. In at least one embodiment, the pole-receiving cavity 120 includes threads for receiving mating threads of the extension pole 104.

The actuation member mount 114 is attached to the elongated body 110. The actuation member 116 is attached at a first end thereof to the actuation member mount 114. The actuation member 116, and thus the entire actuation member as depicted in FIG. 1, extends at least partially across the first end of the elongated body 110 through the longitudinal axis L2 of the aerosol dispenser-receiving cavity 118. Preferably, but not necessarily, the actuation member 116 is centered on the longitudinal axis L2 of the aerosol dispenser receiving cavity 118.

A spray head engagement portion 122 of the actuation member 116 is selectively movable between an at-rest position (depicted in FIG. 1) and a displaced position (i.e. displaced toward the elongated body). In the embodiment of the actuation member 116 depicted in FIG. 1, the spray head engagement portion 122 is not separately movable with respect to other portions of the actuation member 116. The spray head engagement portion 122 of the actuation member 116 includes a spray head engaging protrusion 123. The spray head engagement protrusion 123 is centered on the longitudinal axis L2, the portion of the actuation member 116. In this manner, selective activation of a spray head of a spray head of an aerosol dispenser is enabled, while avoiding adverse (e.g., off-center) forces acting on the spray head. Minimizing, if not precluding, such adverse forces is desirable for preventing the spray head from being damaged and/or detached during its operation.

Some aerosol dispensers include a shroud around the spray head of the aerosol dispenser. The spray head engagement protrusion 123 at least partially extends into such a shroud for allowing selective operation of the spray head via the actuation member 116. The spray head protrusion 123 is generally positioned on (e.g., centered on) the longitudinal axis L2 of the aerosol dispenser-receiving cavity 118, thus resulting in actuation forces applied by the actuation member 116 on a spray head of an aerosol can being directed along the longitudinal axis L2 of the aerosol-dispenser receiving cavity 118. It is advantageous for the longitudinal axis L2 of the aerosol dispenser-receiving cavity 118 and the longitudinal axis L1 of a pole-receiving cavity 120 to be generally aligned and for such actuation forces to be directed generally along these longitudinal axes. Such an arrangement reduces adverse force distribution within the apparatus 100, thus reducing cost, simplifying construction and enhancing robustness of the apparatuses in accordance with embodiments of the disclosures made herein.

A wall 124 (FIG. 2) at the second end of the elongated body 110 defines the closed end of the aerosol dispenser-receiving cavity 118. The extension pole mount 112 is attached to the wall 124 on a side of the wall opposite the aerosol dispenser-receiving cavity 118. In at least one embodiment, the extension pole mount 112, the elongated body 110 and the actuation member mount 114 are unitary. The term unitary as used herein refers to a plurality of elements being a one-piece structure (e.g., injection molded as a single piece).

Preferably, the actuation member 116 (FIG. 1) extends completely across the first end of the elongated body 110. The lanyard 108 is attached to a second end of the actuation member 116. Accordingly, the spray head engagement portion 122 of the actuation member 116 is positioned between the first end and the second end of the actuation member 116. The longitudinal axis L2 of the aerosol dispenser-receiving cavity 118 intersects the actuation member 116 at a position approximately equidistant between an actuation member mount attachment point 126 at the first end of the actuation member 116 and a control element attachment point 128 at the second end of the actuation member 116.

As depicted in FIG. 1, the actuation member 116 is pivotally attached at the first end thereof to the actuation member mount 114. The actuation member mount 114 includes a slotted portion 130 that extends beyond the first end of the elongated body 110. A longitudinal axis L3 of a slot 132 of the slotted portion 130 extending generally parallel to the longitudinal axis L2 of the aerosol dispenser-receiving cavity 118. The actuation member 116 is mounted on the slot 132 in a manner enabling the actuation member 116 to be translatable along the longitudinal axis L3 of the slot 132 and to be pivotable about an axis extending generally normal to the longitudinal axis L3 of the slot 132. The actuation member 116 is attached in a manner wherein the pivot point of the actuation member 116 does not inadvertently translate while operating the spray head of the aerosol dispenser.

It is contemplated herein that the slot 132 may be replaced by a plurality of holes. In such an embodiment, the actuation member 116 is discretely adjustable along the length of the actuation member mount 114 rather than being translatable.

One embodiment of mounting the actuation member 116 on the slot 132 includes providing a fastener (e.g., a bolt/nut, screw/nut or rivet) through both a hole in the first end of the actuation member 116 and the slot 132. The fastener is attached in a manner that permits the actuation member to be pivotable about a longitudinal axis of the fastener and that permits the fastener to be translatable within the slot. To control an ability to pivot the actuation member 116, limit play between the actuation member 116 and the actuation member mount 114 and to address overall pivot/translation requirements, a known preload sleeve arrangement may be used. An example of such a known preload sleeve arrangement includes extending a sleeve that is slightly longer than the actuation member 116 is thick through the hole in the first end of the actuation member 116. Washers are then positioned adjacent to opposing faces of the sleeve and the fastener is provided through the washers, the sleeve and the slot. In this manner, the fastener may be tightened such that it is pre-loaded against the sleeve, preventing unintentional translation of the actuation member 116 without inducing an adverse degree of pivotal bind between the actuation member mount 114 and the actuation member 116.

Still referring to FIG. 1, the actuation handle assembly 106 includes a handle 134 and a handle mounting bracket 136. The handle mounting bracket 136 is attached to the extension pole 104. It is contemplated herein that the handle mounting bracket 136 may be unitary with the extension pole 104. The handle 134 is pivotally attached to the handle mounting bracket 136 in a manner enabling the handle 134 to be movable between an at-rest position and a displaced position. The lanyard 108 is attached to between the handle 134 and the actuation member 116 in a manner wherein moving the handle 134 from its at-rest position toward its displaced position results in a corresponding movement of the actuation member 116 from its at-rest position towards its displaced position, thus enabling a spray head of an aerosol dispenser to be selectively operated.

Attaching the lanyard 108 to the handle 134 at a distant position from a pivot axis of the handle 134 aids in generating adequate displacement of the actuating lanyard when the handle is moved from its at-rest position toward its displaced position. In this manner, adverse affects of stretch in the lanyard 108 are minimized such that sufficient displacement of the actuation member 116 is achieved for selectively depressing the spray head of the aerosol dispenser. Furthermore, because the actuation member mount 114 and the lanyard 108 are attached to opposite ends of the actuation member 116, the degree of force required to be exerted by the lanyard 108 for depressing the spray head is reduced relative to the lanyard 108 being attached to the actuation member at an attachment point closer to the actuation member mount 114.

As depicted in FIG. 2, a removable centering insert 138 is mountable in the aerosol dispenser-receiving cavity 118. The removable centering insert 138 is generally concentric with the aerosol dispenser-receiving cavity 118. Without the removable centering insert mounted in the aerosol-dispenser-receiving cavity 118, the aerosol dispenser-receiving cavity 118 is intended to properly receive an aerosol dispenser of a default size (e.g., of a default diameter). The removable centering insert 138 is one embodiment of a means for centering an aerosol dispenser, which is smaller than the default size, within an aerosol dispenser-receiving cavity 118.

Turning now to operation of the apparatus 100 (i.e., an apparatus in accordance with an embodiment of the disclosures made herein), an aerosol dispenser 119 including a spray head is positioned in the aerosol dispenser-receiving cavity 118 of the apparatus 100 with the actuation member 116 pivoted suitably out of the way. Once the aerosol dispenser 119 is positioned in the aerosol dispenser-receiving cavity 118, the actuation member 116 is pivoted to its at-rest position on top of the spray head. With the actuation member 116 resting on the spray head of the aerosol dispenser 121, the first end of the actuation member 116 is adjusted relative to the slot 132 of the actuation member mount 114, if needed. Preferably, the actuation member 116 is adjusted such that a longitudinal axis L4 of the actuation member 116 to be in an approximately normal orientation with respect to the longitudinal axis L2 of the aerosol dispenser-receiving cavity 118 when the actuation member 116 is in its at-rest position.

It is beneficial to adjust the actuation member 116 in such an at-rest orientation to limit skewed forces (i.e., relative to the longitudinal axis L2 of the aerosol dispenser-receiving cavity 118) acting on the spray head when the actuation member 116 is moved toward its displaced position. Skewed forces are known to result in inadvertent detachment of the spray head from the aerosol dispenser and/or unpredictable operation of the spray head. Accordingly, constructing and/or orientating the actuation member as disclosed herein are advantageous as such construction and orientation limits such skewed forces on the spray head.

When the handle 134 is moved sufficiently from its at-rest position toward its displaced position (e.g., toward the extension pole 104), the actuation member 116 is correspondingly displaced resulting in the spray head of the aerosol dispenser 119 being depressed to its "on" position for allowing a composition in the aerosol dispenser to be dispensed. Releasing the actuating member 116 allows a natural spring action of the spray head to return the spray head to its "off" position. The aerosol dispenser 119 and/or spray head is positionable (e.g., rotated to a suitable position) such that the composition is dispensed in a manner wherein it does not hit the actuation member mount 114 or the lanyard 108.

Figure 3:
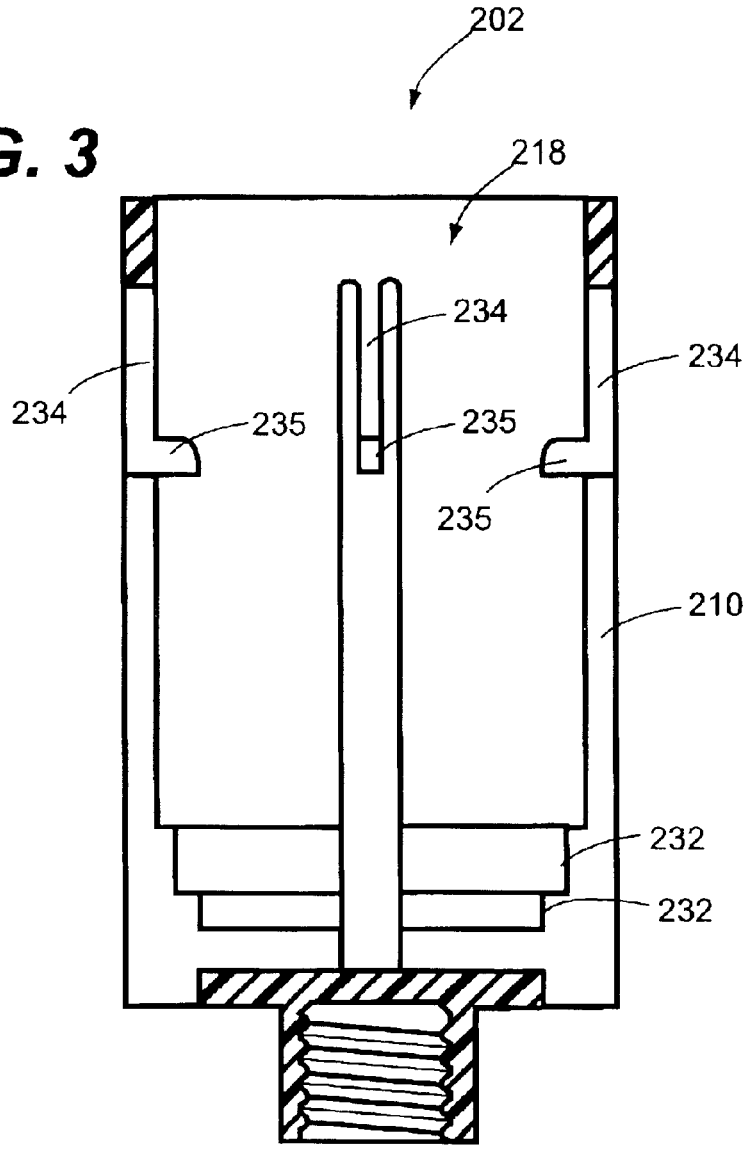
FIG. 3 depicts an embodiment of a head assembly including a body having a plurality of resilient centering members attached at a first end of a body and a fixed centering member attached at a second end of the body.

FIG. 3 depicts a head assembly 202 including a body 210, a plurality of fixed centering members 232 and a plurality of resilient centering members 234. The plurality of resilient centering members 234 are attached to the elongated body 210 adjacent to a first end of the elongated body 210. Each one of the resilient centering members 234 includes a container engagement portion 235 positioned within the aerosol dispenser-receiving cavity 218. The fixed centering members 232 are attached to an elongated body 210 within an aerosol dispenser-receiving cavity 218 adjacent to a second end of the elongated body 210. The plurality of fixed centering members 232 and the plurality of resilient centering members 234 represent another embodiment of the means for centering an aerosol dispenser within an aerosol dispenser-receiving cavity. It is contemplated herein that the fixed centering members 232 and the resilient centering members 234 may be unitary with the elongated body 210.

Still another embodiment (not shown) of the means for centering the aerosol dispenser within an aerosol dispenser-receiving cavity includes a plurality of resilient centering members attached to an elongated body of a head assembly at both a first end and a second end of the elongated body.

FIG. 4 depicts an embodiment of a head assembly 302 including an elongated body 310, an extension pole mount 312, an actuation member mount 314 and an actuation member 316. The actuation member 316 is mounted on the actuation member mount 314 in a manner wherein a first end of the actuation member 316 is substantially constrained from pivoting with respect to the actuation member mount 314. The actuation member mount 314 includes a channel portion 330 extending beyond a first end of the elongated body. A longitudinal axis L5 of a channel 333 of the channel portion 330 extends generally parallel to a longitudinal axis L6 of an aerosol dispenser-receiving cavity 318 of the elongated body 310. A channel having a "T" shaped cross section is an example of the channel 333 of the channel portion 330.

Referring to FIGS. 4 and 5, a flange 335 is provided at the first end of the actuation member 316. The flange 335 is translatably mounted in the channel 333 of the channel portion 330, thus enabling the actuation member 316 to be translatable along the longitudinal axis L5 of the channel 333. The flange 335 includes an anti-rotation element 337 (e.g., a rib) mounted in the channel 333. The anti-rotation element 337 substantially constrains the first end of the actuation member 316 from pivoting with respect to the actuation member mount 314.

The actuation member 316 includes an integral spring member 317. The integral spring member 317 is positioned between the first end of the actuation member 316 and a spray head engagement portion 322 of the actuation member 316. In the embodiment of the actuation member 316 depicted in FIGS. 4 and 5, the spray head engagement portion 322 of the actuation member 316 is separately movable with respect to the first end of the actuation member 316. In this manner, the spray head engagement portion 322 is enabled to be selectively movable between an at-rest position and a displaced position. Position and orientation aspects of the spray head engagement portion 322 as well as the overall operation of the head assembly 302 are substantially the same as disclosed above in reference to FIG. 1.

The integral spring member 317 is an embodiment of a means for enabling displacement of a head engagement portion of an actuation member. An integral hinge (e.g. an living hinge) is another embodiment of the means for enabling displacement of a head engagement portion of an actuation member. It is contemplated herein that other embodiments of means for enabling displacement of a head engagement portion of an actuation member may be implemented in head assemblies in accordance with embodiments of the disclosures made herein.

It is contemplated herein that components of the head assemblies and handle assemblies in accordance with embodiments of the disclosures made herein may be made from any one of a variety of known commercially available materials. Examples of such materials include filled and unfilled polymers. Such known materials may be processed using known processing techniques such as injection molding, extrusion, vacuum forming etc.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An apparatus, comprising:

an elongated body including an aerosol dispenser-receiving cavity therein, wherein the aerosol dispenser-receiving cavity extends from a first end of said body toward a second end of said body;

an extension pole mount attached to the second end of said body, wherein a longitudinal axis of a pole-receiving cavity of the extension pole mount is generally aligned with a longitudinal axis of the aerosol dispenser-receiving cavity;

an actuation member mount attached to said body; and an actuation member attached at a first end thereof to the actuation member mount, wherein a spray head engagement portion of the actuation member extends at least partially across the first end of said body through the longitudinal axis of the aerosol dispenser-receiving cavity and wherein the spray head engagement portion is selectively movable between an at-rest position and a displaced position for enabling selective activation of a spray head of an aerosol dispenser.

2. The apparatus of claim 1 wherein the aerosol dispenser-receiving cavity is a generally cylindrical cavity.

3. The apparatus of claim 1 wherein:

a wall defines a closed end of the aerosol dispenser-receiving cavity adjacent to the second end of said body; and the extension pole mount is attached to the wall.

4. The apparatus of claim 1 wherein the extension pole mount, said body and the actuation member mount are unitary.

5. The apparatus of claim 1, further comprising:

a manually operable control element attached to a second end of the actuation member.

6. The apparatus of claim 5 wherein:

the actuation member extends completely across the first end of said body; and the longitudinal axis of the aerosol dispenser-receiving cavity intersects the actuation member at a position approximately equidistant between an actuation member mount attachment point of the actuation member and a control element attachment point of the actuation member.

7. The apparatus of claim 1 wherein:

the actuation member includes a spray head engaging protrusion; and the spray head protrusion is generally centered on the longitudinal axis of the aerosol dispenser-receiving cavity.

8. The apparatus of claim 1, further comprising:

a removable centering insert mounted in the aerosol dispenser-receiving cavity, wherein the removable centering insert is generally concentric with the aerosol dispenser-receiving cavity.

9. The apparatus of claim 1 further comprising:

a fixed centering member attached to said body within the aerosol dispenser-receiving cavity adjacent to a second end of said body; and a plurality of resilient centering members attached to said body adjacent to the first end of said body, wherein each one of said resilient centering members include a container engagement portion positioned within the aerosol dispenser-receiving cavity.

10. The apparatus of claim 1, further comprising:

a first plurality of resilient centering members attached to said body adjacent to the first end of said body; and a second plurality of resilient centering members attached to said body adjacent to the second first end of said body;

wherein each one of said resilient centering members include a container engagement portion positioned within the aerosol dispenser-receiving cavity.

11. The apparatus of claim 1, further comprising:

means for centering an aerosol dispenser within the aerosol dispenser-receiving container.

12. The apparatus of claim 1 wherein the actuation member being attached to the actuation member mount includes the actuation member being pivotally attached at a first end thereof to the actuation member mount.

13. The apparatus of claim 12 wherein:

the actuation member mount includes a slotted portion extending beyond the first end of said body;

a longitudinal axis of a slot of the slotted portion extending generally parallel to the longitudinal axis of the aerosol dispenser-receiving cavity; and the actuation member being attached to the actuation member mount includes the actuation member being translatably mounted on the slot of the slotted portion, whereby the actuation member is translatable along a longitudinal axis of the slot and is pivotable about an axis extending generally normal to the longitudinal axis of the slot.

14. The apparatus of claim 13, further comprising:

a fastener extending through both a hole in the first end of the actuation member and the slot, wherein the actuation member is pivotable about a longitudinal axis of the fastener and first end of the actuation member is translatable along the longitudinal axis of the slot.

15. The apparatus of claim 1 wherein:

the actuation member being mounted to the actuation member mount includes the first end of the actuation member being substantially constrained from pivoting with respect to the actuation member mount; and the actuation member includes at least one of a hinge and a spring member integrally formed therein between the first end and the spray head engagement portion of the actuation member, whereby the spray head engagement portion is enabled to be selectively movable between the at-rest position and the displaced position.

16. The apparatus of claim 15 wherein:

the actuation member mount includes a channel portion extending beyond the first end of said body;

a longitudinal axis of a channel of the channel portion extending generally parallel to the longitudinal axis of the aerosol dispenser-receiving cavity;

the actuation member being attached to the actuation member mount includes a flange at the first end of the actuation member being translatably mounted in the channel of the channel portion, whereby the actuation member translatable along an axis of the channel.

17. The apparatus of claim 16 wherein the flange includes an anti-rotation element mounted in the channel in a manner whereby the first end of the actuation member is substantially constrained from pivoting with respect to the actuation member mount.

18. An apparatus, comprising:

an elongated body including an aerosol dispenser-receiving cavity therein, wherein the aerosol dispenser-receiving cavity extends from a first end of said body toward a second end of said body;

means for centering an aerosol dispenser within the aerosol dispenser-receiving container;

an extension pole mount attached to the second end of said body, wherein a longitudinal axis of a pole-receiving cavity of the extension pole mount is generally aligned with a longitudinal axis of the aerosol dispenser-receiving cavity;

an actuation member mount attached to said body;

an actuation member attached at a first end thereof to the actuation member mount, wherein a spray head engagement portion of the actuation member extends at least partially across the first end of said body through the longitudinal axis of the aerosol dispenser-receiving cavity and wherein the spray head engagement portion is selectively movable between an at-rest position and a displaced position for enabling selective activation of a spray head of an aerosol dispenser; and a manually operable control element attached to a second end of the actuation member.

19. The apparatus of claim 18 wherein the actuation member being attached to the actuation member mount includes the actuation member being pivotally attached at a first end thereof to the actuation member mount.

20. The apparatus of claim 19 wherein:

the actuation member mount includes a slotted portion extending beyond the first end of said body;

a longitudinal axis of a slot of the slotted portion extending generally parallel to the longitudinal axis of the aerosol dispenser-receiving cavity; and the actuation member being attached to the actuation member mount includes the actuation member being translatably mounted on the slot of the slotted portion, whereby the actuation member is translatable along a longitudinal axis of the slot and is pivotable about an axis extending generally normal to the longitudinal axis of the slot.

21. The apparatus of claim 18 wherein:

the actuation member being mounted to the actuation member mount includes the first end of the actuation member being substantially constrained from pivoting with respect to the actuation member mount; and the actuation member includes at least one of a hinge and a spring member integrally formed therein between the first end and the spray head engagement portion of the actuation member, whereby the spray head engagement portion is enabled to be selectively movable between the at-rest position and the displaced position.

22. The apparatus of claim 21 wherein:

the actuation member mount includes a channel portion extending beyond the first end of said body;

a longitudinal axis of a channel of the channel portion extending generally parallel to the longitudinal axis of the aerosol dispenser-receiving cavity;

the actuation member being attached to the actuation member mount includes a flange at the first end of the actuation member being translatably mounted in the channel of the channel portion, whereby the actuation member translatable along an axis of the channel.

23. The apparatus of claim 22 wherein the flange includes an anti-rotation element mounted in the channel in a manner whereby the first end of the actuation member is substantially constrained from pivoting with respect to the actuation member mount.

24. An apparatus, comprising:

an elongated one-piece body including an aerosol dispenser-receiving cavity therein, wherein the aerosol dispenser-receiving cavity extends from a first end of said body toward a second end of said body;

an extension pole mount attached to the second end of said body, wherein a longitudinal axis of a pole-receiving cavity of the extension pole mount is generally aligned with a longitudinal axis of the dispenser-receiving cavity; and means for actuating a spray head of an aerosol dispenser, wherein said means for actuating is mounted on said body, includes a head engagement portion intersecting the longitudinal axis of the dispenser-receiving cavity and is selectively movable between an at-rest position and a displaced position for enabling selective activation of a spray head of an aerosol dispenser.

25. The apparatus of claim 24 wherein:

the actuation member extends completely across the first end of said body; and the longitudinal axis of said aerosol dispenser-receiving cavity intersects the actuation member at a position approximately equidistant between an actuation member mount attachment point of the actuation member and a control element attachment point of the actuation member.

26. The apparatus of claim 24 wherein:

the actuation member includes a spray head engaging protrusion; and the spray head protrusion is generally centered on the longitudinal axis of the aerosol dispenser-receiving cavity.

27. The apparatus of claim 24, further comprising:

a removable centering insert mounted in the aerosol dispenser-receiving cavity, wherein the removable centering insert is generally concentric with the aerosol dispenser-receiving cavity.

28. The apparatus of claim 24 further comprising:

a fixed centering member attached to said body within the aerosol dispenser-receiving cavity adjacent to a second end of said body; and a plurality of resilient centering members attached to said body adjacent to the first end of said body, wherein each one of said resilient centering members include a container engagement portion positioned within the aerosol dispenser-receiving cavity.

29. The apparatus of claim 24 further comprising:

a first plurality of resilient centering members attached to said body adjacent to the first end of said body; and a second plurality of resilient centering members attached to said body adjacent to the second first end of said body;

wherein each one of said resilient centering members include a container engagement portion positioned within the aerosol dispenser-receiving cavity.

30. The apparatus of claim 24, further comprising:

means for centering an aerosol dispenser within the aerosol dispenser-receiving container.

31. The apparatus of claim 24 wherein said means for actuating includes:

an actuation member mount attached to said body; and an actuation member attached at a first end thereof to the actuation member mount, wherein a spray head engagement portion of the actuation member extends at least partially across the first end of said body through the longitudinal axis of the aerosol dispenser-receiving cavity and wherein the spray head engagement portion is selectively movable between an at-rest position and a displaced position for enabling selective activation of a spray head of an aerosol dispenser.

32. The apparatus of claim 31 wherein the actuation member being attached to the actuation member mount includes the actuation member being pivotally attached at the first end thereof to the actuation member mount.

33. The apparatus of claim 32 wherein:

the actuation member mount includes a slotted portion extending beyond the first end of said body;

a longitudinal axis of a slot of the slotted portion extending generally parallel to the longitudinal axis of the aerosol dispenser-receiving cavity; and the actuation member being attached to the actuation member mount includes the actuation member being translatably mounted on the slot of the slotted portion, whereby the actuation member is translatable along a longitudinal axis of the slot and is pivotable about an axis extending generally normal to the longitudinal axis of the slot.

34. The apparatus of claim 32 wherein:

the actuation member being mounted to the actuation member mount includes the first end of the actuation member being substantially constrained from pivoting with respect to the actuation member mount; and the actuation member includes at least one of a hinge and a spring member integrally formed therein between the first end and the spray head engagement portion of the actuation member, whereby the spray head engagement portion is enabled to be selectively movable between the at-rest position and the displaced position.

35. The apparatus of claim 34 wherein:

the actuation member mount includes a channel portion extending beyond the first end of said body;

a longitudinal axis of a channel of the channel portion extending generally parallel to the longitudinal axis of the aerosol dispenser-receiving cavity;

the actuation member being attached to the actuation member mount includes a flange at the first end of the actuation member being translatably mounted in the channel of the channel portion, whereby the actuation member translatable along an axis of the channel.

36. The apparatus of claim 35 wherein the flange includes an anti-rotation element mounted in the channel in a manner whereby the first end of the actuation member is substantially constrained from pivoting with respect to the actuation member mount.

37. An apparatus, comprising:

an extension pole mount including an extension pole receiving cavity passage therein;

means for holding an aerosol dispenser; and means for actuating a spray head of the aerosol dispenser, wherein:

said means for holding is attached to the extension pole mount and includes an aerosol dispenser-receiving cavity therein;

a longitudinal axis of the extension pole-receiving cavity is generally aligned with a longitudinal axis of the aerosol dispenser-receiving cavity;

the means for actuating includes a head engagement portion intersecting the longitudinal axis of the aerosol dispenser-receiving cavity;

the head engagement portion is selectively movable between an at-rest position and a displaced position for enabling selective activation of a spray head of the aerosol dispenser; and the head engagement portion is translatable along an axis extending generally parallel to the longitudinal axis of the aerosol dispenser-receiving cavity.

* * * * *